US011479735B2

(12) United States Patent
Iyer et al.

(10) Patent No.: US 11,479,735 B2
(45) Date of Patent: Oct. 25, 2022

(54) LUBRICATING AND COOLING FLUID FOR AN ELECTRIC MOTOR SYSTEM

(71) Applicant: Afton Chemical GmbH, Hamburg (DE)

(72) Inventors: Ramnath Iyer, Glen Allen, VA (US); Christian Windel, Weinstadt (DE); Jörg Meyer-Berge, Lorch (DE)

(73) Assignees: Afton Chemical GMBH, Hamburg (DE); Mercedes-Benz Group AG, Struttgart (DE)

( * ) Notice: Subject to any disclaimer, the term of this patent is extended or adjusted under 35 U.S.C. 154(b) by 0 days.

(21) Appl. No.: 17/206,888

(22) Filed: Mar. 19, 2021

(65) Prior Publication Data

US 2022/0298449 A1 Sep. 22, 2022

(51) Int. Cl.
*C10M 169/04* (2006.01)
*C10M 143/06* (2006.01)
(Continued)

(52) U.S. Cl.
CPC ..... *C10M 169/044* (2013.01); *C10M 133/08* (2013.01); *C10M 135/06* (2013.01); *C10M 135/36* (2013.01); *C10M 143/06* (2013.01); *C10M 2205/003* (2013.01); *C10M 2205/026* (2013.01); *C10M 2215/042* (2013.01); *C10M 2215/064* (2013.01); *C10M 2219/106* (2013.01); *C10N 2010/06* (2013.01); *C10N 2010/10* (2013.01); *C10N 2020/04* (2013.01); *C10N 2030/04* (2013.01); *C10N 2030/06* (2013.01); *C10N 2030/10* (2013.01);
(Continued)

(58) Field of Classification Search
CPC ..... C10M 169/044; C10M 133/08; C10M 135/06; C10M 135/36; C10M 143/06; C10M 2205/003; C10M 2205/026; C10M 2215/042; C10M 2215/064; C10M 2219/106; C10N 2010/06; C10N 2010/10; C10N 2020/04; C10N 2030/04; C10N 2030/06; C10N 2030/10; C10N 2030/12; C10N 2040/04; C10N 2040/40
See application file for complete search history.

(56) References Cited

U.S. PATENT DOCUMENTS

2002/0151441 A1* 10/2002 Srinivasan ..... C10M 169/045 508/486
2002/0151443 A1* 10/2002 Srinivasan ..... C10M 167/00 508/273
(Continued)

FOREIGN PATENT DOCUMENTS

FR 3097873 A1 1/2021

OTHER PUBLICATIONS

PCT; App. No. PCT/IB2021/062427; International Search Report and Written Opinion dated Apr. 7, 2022.

*Primary Examiner* — Pamela H Weiss
(74) *Attorney, Agent, or Firm* — Honigman LLP

(57) ABSTRACT

A lubricating and cooling fluid for an electric motor system including a lubricating base oil, at least one sulfurized component, a dispersant system comprising at least two dispersants, and a friction modifier system comprising at least two friction modifiers. The lubricating and cooling fluid provides good wear and friction performance as well as good copper corrosion and electrical conductivity for use in electric motor system.

39 Claims, 1 Drawing Sheet

(51) Int. Cl.

| | |
|---|---|
| ***C10M 133/08*** | (2006.01) |
| ***C10M 135/06*** | (2006.01) |
| ***C10M 135/36*** | (2006.01) |
| ***C10N 30/04*** | (2006.01) |
| ***C10N 10/06*** | (2006.01) |
| ***C10N 10/10*** | (2006.01) |
| ***C10N 20/04*** | (2006.01) |
| ***C10N 30/06*** | (2006.01) |
| ***C10N 30/12*** | (2006.01) |
| ***C10N 30/10*** | (2006.01) |
| ***C10N 40/04*** | (2006.01) |
| ***C10N 40/00*** | (2006.01) |

(52) U.S. Cl.
CPC ..... *C10N 2030/12* (2013.01); *C10N 2040/04* (2013.01); *C10N 2040/40* (2020.05)

(56) References Cited

U.S. PATENT DOCUMENTS

| | | | | |
|---|---|---|---|---|
| 2016/0024416 | A1* | 1/2016 | Kamano | C10M 141/08 508/192 |
| 2018/0100118 | A1* | 4/2018 | Flores-Torres | C10M 169/04 |
| 2019/0078034 | A1 | 3/2019 | Saccomando et al. | |
| 2021/0009920 | A1 | 1/2021 | Kwak | |

* cited by examiner

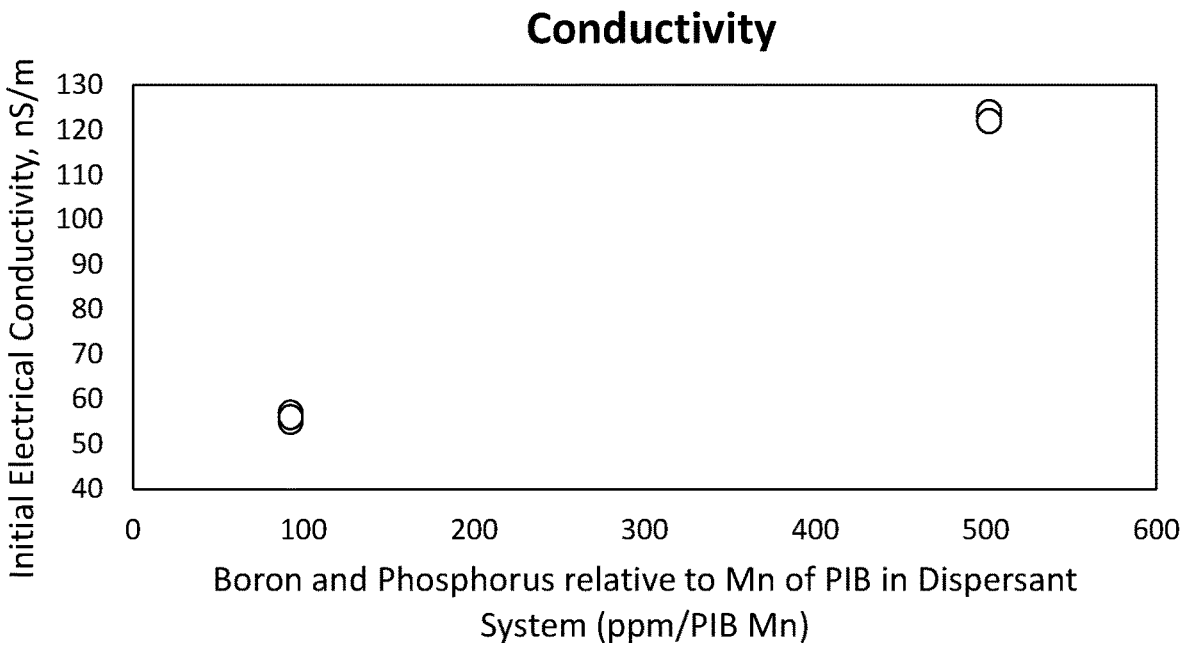
Conductivity
Initial Electrical Conductivity, nS/m
130
120
110
100
90
80
70
60
50
40
0
100
200
300
400
500
600
Boron and Phosphorus relative to Mn of PIB in Dispersant System (ppm/PIB Mn)

LUBRICATING AND COOLING FLUID FOR AN ELECTRIC MOTOR SYSTEM

FIELD

The present disclosure relates to a lubricating and cooling fluid for an electric motor system and a method of lubricating gears and clutches and cooling a motor in an electric motor system. In particular, the disclosed methods and fluid relate to a lubricating and cooling fluid for use in electric motor vehicle, comprising an oil of lubricating viscosity, a sulfurized component, a dispersant system comprising at least two dispersants, and a friction modifier system having at least three friction modifiers.

BACKGROUND

In electric vehicle powertrains that include an electric motor as the sole driving source, a single lubricant may be required to both lubricate the gears and clutches and cool the electric motor. A major challenge in developing these types of lubricants is achieving wear performance, friction performance, and oxidation stability, while ensuring lubricant compatibility with electrified components in the powertrain. For example, the lubricant must provide gears and clutches within the electric vehicle powertrain good wear protection and friction performance, respectively. However, because the lubricant is also used to cool the electric motor (e.g., by contacting the copper windings in the stator which operate at high temperatures), the lubricant must also provide copper corrosion protection and have relatively low electrical conductivity to inhibit electrostatic buildup and discharge in the electrified components.

Despite advances in lubricant technology for electric vehicle powertrains, there is a need for an electric vehicle powertrain lubricant composition having desired wear performance, oxidation stability, copper corrosion inhibition, and/or relatively low lubricant electrical conductivity.

SUMMARY

In one embodiment, a method for lubricating gears and clutches in an electric motor system and simultaneously cooling a motor thereof is provided by the present disclosure. The method includes operating an electric motor system, containing a lubricating and cooling fluid, such that a temperature of the lubricating and cooling fluid in a sump of the electric motor system is about 70° C. to about 125° C. and the temperature of copper windings in a stator of the electric motor system is between 150° C. to about 180° C.; lubricating gears and clutches in the electric motor system with the lubricating and cooling fluid and simultaneously cooling the motor in the electric motor system by contacting the copper windings with the lubricating and cooling fluid; and wherein the lubricating and cooling fluid includes an oil of lubricating viscosity including an API Group III base oil, API Group IV base oil, or mixtures thereof; at least one thiadiazole or hydrocarbyl-substituted derivatives thereof delivering about 1000 to about 1500 ppm sulfur to the lubricating fluid; a dispersant system including (i) a first dispersant obtained from polyisobutylene having a number average molecular weight of about 1500 to about 2500 and delivering up to about 700 ppm nitrogen to the lubricating and cooling fluid and (ii) a second dispersant having a number average molecular weight of about 1000 or less and delivering up to about 150 ppm nitrogen to the lubricating fluid; an alkoxylated aliphatic amine delivering up to about 20 ppm nitrogen to the lubricating and cooling fluid; an ether amine delivering up to about 20 ppm nitrogen to the lubricating and cooling fluid.

In some approaches or embodiments, at least one of the first dispersant and the second dispersant is borated and phosphorylated such that a total amount of the boron and phosphorus in the dispersant system relative to the nitrogen in the dispersant system is from about 0.5 to about 0.7 and wherein the first and second dispersants deliver up to about 100 ppm of total boron and phosphorus per 1000 number average molecular weight of the combined polyisobutylenes used to obtain the first and second dispersants.

In other approaches or embodiments, the lubricating and cooling fluid used in any of the methods described above may include optional features in any combination. These embodiments may include: the at least one thiadiazole or hydrocarbyl-substituted derivatives thereof includes one or more compounds having a structure of Formula I:

(Formula I)

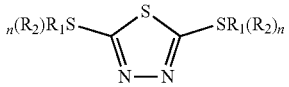

wherein each $R_1$ is independently hydrogen or sulfur; each $R_2$ is independently an alkyl group; n is an integer of 0 or 1 and if $R_1$ is hydrogen then the integer n of the adjacent $R_2$ moiety is 0 and if $R_1$ is sulfur then the n of the adjacent $R_2$ moiety is 1; and wherein at least one $R_1$ is sulfur; and/or wherein the at least one thiadiazole or hydrocarbyl-substituted derivatives thereof is a mixture of hydrocarbyl substituted derivatives of 2,5 dimercapto 1,3 4 thiadiazole including one of 2,5-bis-(nonyldithio)-1,3,4-thiadiazole,2,5-mono-(nonyldithio)-1,3,4- thiadiazole, or combinations thereof; and/or wherein the lubricating and cooling fluid further comprises a fatty diamine delivering up to about 3 ppm nitrogen to the lubricating and cooling fluid; and/or wherein the alkoxylated aliphatic amine, ether amine, and fatty diamine deliver up to about 30 ppm nitrogen to the lubricating and cooling fluid; and/or wherein the alkoxylated aliphatic amine is a di(hydroxyalkyl) aliphatic tertiary amine comprising hydroxyalkyl groups each containing from 2 to 4 carbon atoms, and further comprising an acyclic hydrocarbyl group containing from 16 to 25 carbon atoms; and/or wherein the ether amine comprises isodecyloxypropylamine; and/or wherein the fatty diamine comprises n-oleyl-1, 3-diaminopropane; and/or wherein the alkoxylated aliphatic amine and ether amine each deliver up to about 15 ppm nitrogen to the lubricating and cooling fluid, and wherein the at least one thiadiazole or hydrocarbyl-substituted derivatives thereof is a thiadiazole mixture of hydrocarbyl substituted derivatives of 2,5 dimercapto 1,3,4 thiadiazole including one of 2,5-bis-(nonyldithio)-1,3,4-thiadiazole, 2,5-mono-(nonyldithio)-1,3,4-thiadiazole, or combinations thereof, and wherein the thiadiazole mixture and the optional sulfurized ester deliver about 1400 to about 1800 ppm sulfur to the lubricating and cooling fluid.

In yet further approaches or embodiments, the lubricating and cooling fluid used in any of the methods described above may also include the first dispersant present in an amount to deliver up to about 500 ppm nitrogen to the lubricating and cooling fluid; and/or wherein the second dispersant is present in an amount to deliver about 115 ppm nitrogen to the lubricating and cooling fluid; and/or wherein the first dispersant is obtained from polyisobutylene having a number average molecular weight of about 2000 to about 2400 and the second dispersant is obtained from polyisobutylene having a number average molecular weight of about 950; and/or wherein the first dispersant is present in an amount to deliver up to about 100 ppm of boron and up to about 250 ppm of phosphorus to the lubricating and cooling fluid; and/or wherein the lubricating fluid has a sulfurized ester delivering about 180 to about 300 ppm sulfur to the lubricating and cooling fluid; and/or wherein the at least one thiadiazole or hydrocarbyl-substituted derivatives thereof and the sulfurized ester deliver about 1400 to about 1800 ppm sulfur to the lubricating fluid; and/or wherein the sulfurized ester comprises sulfurized transesterified triglycerides.

In embodiments, the lubricating and cooling fluid used in any methods herein may include a Group III base oil; and/or a gas-to-liquid (GTL) base oil; and/or a polyalphaolefin (PAO) base oil.

In yet other embodiments, the lubricating and cooling fluid used in any of the methods herein, may have an initial electrical conductivity of about 60 nS/M or less, as measured by a modified ASTM D2624-15 using the lubricating and cooling fluid and measured at 20 Hz and at 100° C.

Other embodiments of the present disclosure will be apparent to those skilled in the art from consideration of the specification and practice of the invention disclosed herein.

The following definitions of terms are provided in order to clarify the meanings of certain terms as used herein.

The terms "lubricating oil," "lubricant composition," "lubricating composition," "lubricant" and "lubricating and cooling fluid" refer to a finished lubrication product comprising a major amount of a base oil plus a minor amount of an additive composition.

As used herein, the terms "additive package," "additive concentrate," "additive composition," and "transmission fluid additive package" refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms.

The term "alkenyl" as employed herein refers to straight, branched, cyclic, and/or substituted unsaturated chain moieties from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the "average number molecular weight" or "Mn" is determined by gel permeation chromatography (GPC) using commercially available polystyrene standards (with a Mn of about 180 to about 18,000 as the calibration reference).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DESCRIPTION OF DRAWINGS

FIG. 1 is a chart of conductivity relative to sulfur, phosphorus, and dispersant PIB chain length.

DESCRIPTION OF THE INVENTION

According to an exemplary embodiment, a lubricating and cooling fluid for an electric motor system includes a lubricating base oil of an API Group III base oil, an API Group IV base oil, or mixtures thereof, at least one sulfurized component, a dispersant system comprising at least two dispersants, and a friction modifier system comprising at least two friction modifiers. The at least one sulfurized component includes select additives and amounts of sulfur to achieve relatively low conductivity and good copper corrosion performance. The two dispersants are selected to maintain relatively low conductivity even when providing elements known to be highly conductive. One of the dispersants has a relatively high number average molecular weight of about 1500 to about 2500, and the other dispersant has a relatively low number average molecular weight of less than about 1000. The friction modifiers comprise an alkoxylated aliphatic amine, an ether amine, and optionally a fatty diamine. In another embodiment, the lubricating and cooling fluid includes two sulfurized components. In any embodiment, the lubricating and cooling fluid has a kinematic viscosity of less than about 4.5 cSt at about 100° C., as measured by ASTM D2270-10, and/or has an initial electric conductivity of less than about 60 nS/M, as measured by a modified version ASTM D2624, described in more detail herein.

With fluids for electric motor systems that need to provide not only wear and friction performance but also cooling, low copper corrosion, and low conductivity, there are challenges developing such a robust fluid because elements and components traditionally used in internal combustion engines and transmissions, which contain sulfur, boron, and phosphorus, can negatively impact copper corrosion and/or electrical conductivity. For instance, sulfur can be corrosive to copper, and phosphorus and boron can increase the conductivity of fluids. These undesired effects are magnified at elevated temperatures. Thus, carefully developed fluids are required for electric motors and gears that operate at elevated temperatures. For example, the fluid sump temperatures of the electrical motor system described herein can reach from about 70° C. to about 125° C. Further, the temperature of the copper windings in the stator of the electrical motor system described herein can reach up to 180° C. At these elevated temperatures, additives in the fluid used to achieve good wear and friction performance can be detrimental to maintaining the desired electrical conductivity and copper compatibility.

It was discovered herein, however, that sulfur, phosphorus, and boron can be provided to a fluid for such electric mobility ("e-mobility") applications if such elements are provided by the unique combination of the at least one sulfur component, friction modifier system, and dispersant system described herein. In one approach, for instance, the at least one sulfur component includes select amounts of thiadiazole additives, the friction modifier system includes select amounts of aliphatic amine, ether amine, and optionally, diamine, and the dispersant system includes select amounts of at least two different dispersant additives. In one approach, for instance, at least one of the first dispersant and/or the second dispersant is borated and phosphorylated such that a total amount of boron and phosphorus in the dispersant system relative to the nitrogen in the dispersant system is from about 0.5 to about 0.7 and wherein the first and second dispersants deliver up to about 100 ppm of total boron and phosphorus per 1000 number average molecular weight of the combined polyisobutylene moieties used in the dispersant system.

In such a composition, the fluids herein (even with elements previously known to negatively affect conductivity) results in an initial electric conductivity of less than about 60 nS/M, as measured by a modified version ASTM D2624, described in more detail herein.

In another exemplary embodiment, the disclosure relates to a method of lubricating gears and clutches in an electric motor system while simultaneously cooling an electric motor in the electric motor system. According to this method, the electric motor system, containing a lubricating and cooling fluid, is operated such that the temperature of the lubricating and cooling fluid in electric motor reaches at least about 70° C. in a sump of the electric motor system and, in other embodiments, the lubricating and cooling fluid is about 70 to about 125° C. in the sump of the electric motor system. In another embodiment, the electric motor system, containing a lubricating and cooling fluid, is operated such that the lubricating and cooling fluid contacts the copper windings in the stator of the electrical motor system and such that the copper windings reach a temperature of at least about 150° C. In other embodiments, the electric motor system, containing the lubricating and cooling is operated such that the lubricating and cooling fluid contacts the copper windings and such that the copper windings reach a temperature of at least about 180° C. The lubricating and cooling fluid used in this method comprises at least one lubricating base oil comprising an API Group III base oil, API Group IV base oil, or mixtures thereof, at least one sulfurized component, a dispersant system comprising two dispersants, and a friction modifier system comprising at least two friction modifiers. One of the dispersants has a relatively high number average molecular weight of about 1500 to about 2500. The other dispersant has a relatively low number average molecular weight of less than about 1000. The friction modifiers comprise an alkoxylated aliphatic amine and an ether amine. In an alternate embodiment, the lubricating and cooling fluid contains a fatty diamine as an additional friction modifier. In another embodiment, the lubricating and cooling fluid includes two sulfurized components. In any of the above embodiments of the methods, the lubricating and cooling fluid may have a kinematic viscosity of less than about 4.5 cSt at 100° C., as measured by ASTM D2270-10, and has an initial electric conductivity of less than about 60 nS/M, as measured by a modified version ASTM D2624, described in more detail herein. Any embodiment of the methods herein may also include the noted ratios and relationships of the boron, phosphorus, and nitrogen and/or amounts relative to the molecular weights of the dispersants described above for the lubricating fluids used in the method.

Base Oil:

Base oils suitable for use in formulating the lubricating and cooling fluids for use in electric motor vehicles according to the disclosure may be selected from any of suitable synthetic or natural oils or mixtures thereof having a suitable lubricating viscosity. Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types. Oils derived from coal or shale may also be suitable. Further, oil derived from a gas-to-liquid process is also suitable. The base oil may have a kinematic viscosity at 100° C. of about 2 to about 15 cSt, as measured by ASTM D2270-10.

The base oil as used in the invention described herein may be a single base oil or may be a mixture of two or more base oils. The one or more base oil(s) may be selected from any of the base oils in Groups III or IV as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| API Group I | >0.03 | and/or | <90 | 80 to 120 |
| API Group II | ≤0.03 | and | ≥90 | 80 to 120 |
| API Group III | ≤0.03 | and | ≥90 | ≥120 |
| API Group IV | All polyalphaolefins (PAOs) | | | |
| API Group V | All others not included in Groups I, II, III, or IV | | | |

In one variation, the base oil may be selected from an API Group III base oil, or an API Group IV base oil, or a mixture of these base oils. Alternatively, the base oil may be a mixture of two or more of an API Group III base oils, or two or more of an API Group IV base oils.

API Group III base oils may include oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. These types of oils are commonly referred to as gas-to-liquids (GTLs). For example, the hydrocarbons may be hydroisomerized using processes disclosed in U.S. Pat. Nos. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

API Group IV base oils, PAOs, are typically derived from monomers having from 4 to 30, or from 4 to 20, or from 6 to 16 carbon atoms. Examples of PAOs that may be used in the present invention include those derived from octene, decene, mixtures thereof, and the like. PAOs may have a kinematic viscosity of from 2 to 15, or from 3 to 12, or from 4 to 8 cSt at 100° C., as measured by ASTM D2270-10. Examples of PAOs include 4 cSt at 100° C. PAOs, 6 cSt at 100° C. PAOs, and mixtures thereof.

The base oil(s) are combined with an additive composition as disclosed in embodiments herein to provide a lubricating and cooling fluid for use in an electric motor system having an electric motor, gears, and clutches. Accordingly, the base oil may be present in the lubricating and cooling fluid in an amount greater than about 80 wt % based on the total weight of the lubricating and cooling fluid. In some embodiments, the base oil may be present in the lubricating and cooling fluid in an amount greater than about 85 wt % based on the total weight of the lubricating and cooling fluid.

Additive Composition:

The fluids herein include an additive composition that includes at least a sulfurized component, a friction modifier system or component, and a dispersant system or component. Each will be described below.

The Sulfurized Component:

The lubricating and cooling fluid includes at least a first sulfurized component in balanced amounts to improve wear performance and copper protection. Optionally, a second sulfurized component may also be used in some applications.

The first sulfurized component may be one or more thiadiazole compounds or hydrocarbyl-substituted derivatives thereof or, in other approaches, may be a mixture of thiadiazole compounds or hydrocarbyl-substituted derivatives thereof. Examples of the thiadiazole compound that may be used include 2,5-dimercapto-1,3,4-thiadiazole,2-mercapto-5-hydrocarbylthio-1,3,4-thiadiazole, 2-mercapto-5-hydrocarbyldithio-1,3,4-thiadiazole, 2,5-bis(hydrocarbylthio)- 1,3,4-thiadiazole, or 2,5-bis(hydrocarbyldithio)- 1,3,4-thiadiazoles. The 1,3,4-thiadiazoles are generally synthesized from hydrazine and carbon disulfide by known procedures. See, for example, U.S. Pat. Nos. 2,765, 289; 2,749,311; 2,760,933; 2,850,453; 2,910,439; 3,663,561; 3,862,798; and 3,840,549.

Surprisingly, the form and amounts of the first sulfurized additive herein contributes to the ability of the fluids to maintain a low conductivity, lower copper corrosion, and also meeting other desired friction and wear performance characteristics at the same time. In approaches, the at least one thiadiazole or hydrocarbyl-substituted derivatives thereof includes one or more compounds having a structure of Formula I:

(Formula I)

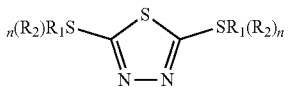

wherein each $R_1$ is independently hydrogen or sulfur, each $R_2$ is independently an alkyl group, n is an integer of 0 or 1 and if $R_1$ is hydrogen then the integer n of the adjacent $R_2$ moiety is 0 and if $R_1$ is sulfur then the n of the adjacent $R_2$ moiety is 1, and with the proviso that at least one $R_1$ is sulfur. In other approaches, the at least one thiadiazole or hydrocarbyl-substituted derivatives thereof is a blend of compounds of Formula Ia and Formula Ib shown below:

(Formula Ia)

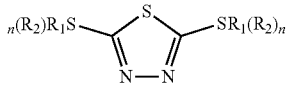

wherein within Formula Ia each integer n is 1, each $R_1$ is sulfur, and each $R_2$ is a C5 to C15 alkyl group, preferably a C8 to C12 alkyl group; and (Formula Ib)

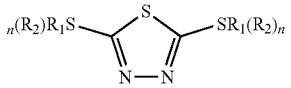

wherein within Formula Ib one integer n is 1 with an associated $R_2$ group being a C5 to C15 alkyl group (preferably a C8 to C12 alkyl group) and the other integer n is 0 and with both $R_1$ groups being sulfur. In some embodiments, the first sulfurized additive includes a blend of Formula Ia and Ib with Formula Ia being a majority of the blend and in other approaches, the blend of Ia and Ib is about 75 to about 90 weight percent of Ia and about 10 to about 25 weight percent of Ib (or other ranges therewithin). In another approach, the first sulfurized additive is a 2,5 dimercapto 1,3,4 thiadiazole including a blend of 2,5-bis-(nonyldithio)-1,3,4-thiadiazole (such as about 75 to about 90%) and 2,5-mono-(nonyldithio)-1,3,4-thiadiazole (such as about 10 to about 25%).

The at least one thiadiazole or hydrocarbyl-substituted derivative thereof are present in the lubricating and cooling fluid in an amount to deliver about 1000 to about 1500 ppm sulfur, about 1200 to about 1500 ppm sulfur, or about 1200 to about 1300 ppm sulfur (or other ranges therewithin). In one embodiment, the at least one thiadiazole or hydrocarbyl-substituted derivatives thereof is 2,5-dimercapto-1,3,4-thiadiazole and this thiadiazole compound is present in the lubricating and cooling fluid an amount to deliver about 1000 to about 1500 ppm sulfur, about 1200 to about 1500 ppm sulfur, or about 1200 to about 1300 ppm sulfur (or other ranges therewithin).

As shown in the examples herein, when the first sulfurized component is present in the lubricating and cooling fluid in an amount to deliver about 1000 to about 1500 ppm sulfur, about 1200 about 1500 ppm sulfur, or about 1200 to about 1300 ppm sulfur (or other ranges therewithin), the resulting composition provides for improved FZG Scuffing scores and/or decreased copper corrosion. When the first sulfurized component is present in the lubricating and cooling fluid in an amount less than 1000 ppm sulfur or greater than 1500 ppm sulfur, the resulting composition provides poor FZG Scuffing score and/or increased copper corrosion.

The lubricating and cooling fluid may optionally comprise a second sulfurized component in the form of a sulfurized ester. Examples of sulfurized esters include those produced by sulfurizing animal or vegetable fats and oils such as beef tallow lard, fish oil, rapeseed oil, and soybean oil; unsaturated fatty acid esters produced by reacting unsaturated fatty acids such as oleic acid, linoleic acid, and fatty acids extracted from the foregoing animal or vegetable fats and oils with various alcohols; or mixtures thereof, by any suitable method. In one embodiment, the sulfurized component is sperm oil or synthetic sperm oil and is comprised of sulfurized transesterified triglycerides.

The optional sulfurized ester may be present in the lubricating and cooling fluid in an amount to deliver up to about 300 ppm sulfur, about 200 to about 300 ppm sulfur, or about 225 to about 275 ppm sulfur (or other ranges therewithin). In one embodiment, the optional sulfurized ester is sulfurized synthetic sperm oil comprised of sulfurized transesterified triglycerides and may be present in the lubricating and cooling fluid an amount to deliver about 200 to about 300 ppm sulfur or about 225 to about 275 ppm sulfur (or other ranges therewithin).

When both sulfurized components are present in the lubricating and cooling fluid, they are present in an amount to deliver a total sulfur in an amount of about 1400 to about 1800 ppm sulfur or about 1400 to about 1500 ppm sulfur (or other ranges therewithin). In one embodiment the first sulfurized component is 2,5-dimercapto-1,3,4-thiadiazole and/or a hydrocarbyl-substituted derivative thereof and the optional second sulfurized component is sulfurized synthetic sperm oil comprised of sulfurized transesterified triglycerides. In this embodiment, the first sulfurized component is present in the lubricating and cooling fluid in an amount to deliver about 1200 to about 1300 ppm sulfur and the optional second sulfurized component is present in the lubricating and cooling fluid in an amount to deliver about 225 to about 275 ppm sulfur. In this embodiment, the first and optional second sulfurized components may be present in the lubricating and cooling fluid in an amount to deliver about 1400 to about 1500 ppm total sulfur.

The Dispersant System:

The lubricating and cooling fluid described herein contains a dispersant system including at least two dispersants, such as oil-soluble ashless dispersants selected from the group consisting of succinimide dispersants, succinic ester dispersants, succinic ester-amide dispersants, Mannich base dispersants, polymeric polyamine dispersants, phosphorylated forms thereof, and borated forms thereof. The dispersants may be capped with acidic molecules capable of reacting with secondary amino groups.

Hydrocarbyl-dicarboxylic acid or anhydrides reacted with polyalkylene polyamines are used to make succinimide dispersants. Succinimide dispersants and their preparation are disclosed in U.S. Pat. No. 7,897,696 and U.S. Pat. No. 4,234,435, which are incorporated herein by reference. The hydrocarbyl moiety of the hydrocarbyl-dicarboxylic acid or anhydride of may be derived from butene polymers, for example polymers of isobutylene. Suitable polyisobutenes for use herein include those formed from conventional polyisobutylene or highly reactive polyisobutylene having at least 60%, such as 70% to 90% and above, terminal vinylidene content. Suitable polyisobutenes may include those prepared using $BF_3$ catalysts.

The average number molecular weight of the polyisobutylene substituent of the dispersants may vary over a wide range, for example from about 500 to about 5000, as determined by gel permeation chromatography (GPC) using polystyrene (with a number average molecular weight of 180 to about 18,000) as the calibration reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

The polyisobutylene moiety in a dispersant preferably has a narrow molecular weight distribution (MWD), also referred to as polydispersity, as determined by the ratio of weight average molecular weight (Mw) to number average molecular weight (Mn). Polymers having a Mw/Mn of less than about 2.2, preferably less than about 2.0, are most desirable. Suitable polyisobutylene substituents have a polydispersity of from about 1.5 to about 2.1, or from about 1.6 to about 1.8.

The dicarboxylic acid or anhydride of may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and $C_1$-$C_4$ aliphatic esters. A mole ratio of dicarboxylic acid or anhydride to hydrocarbyl moiety in a reaction mixture used to make the hydrocarbyl-dicarboxylic acid or anhydride may vary widely. Accordingly, the mole ratio may vary from 5:1 to 1:5, for example from 3:1 to 1:3. A particularly suitable molar ratio of acid or anhydride to hydrocarbyl moiety is from 1:1 to less than 1.6:1. Another useful molar ratio of dicarboxylic acid or anhydride to hydrocarbyl moiety is 1.3:1 to 1.7:1, or 1.3:1 to 1.6:1, or 1.3:1 to 1.5:1.

Any of numerous polyalkylene polyamines can be used as in preparing the dispersant additive. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. The molar ratio of hydrocarbyl-dicarboxylic acid or anhydrides to polyalkylene polyamines may be from about 1:1 to about 3.0:1.

In one embodiment, the dispersants in the present disclosure described herein may be the reaction product of a polyisobutenyl succinic anhydride (PIMA), and a polyamine, for example heavy polyamines. The dispersants herein may have a molar ratio of (A) polyisobutenyl-substituted succinic anhydride to (B) polyamine in the range of 4:3 to 1:10.

The Mannich base dispersants may be a reaction product of an alkyl phenol, typically having a long chain alkyl substituent on the ring, with one or more aliphatic aldehydes containing from about 1 to about 7 carbon atoms (especially formaldehyde and derivatives thereof), and polyamines (especially polyalkylene polyamines). For example, a Mannich base ashless dispersants may be formed by condensing about one molar proportion of long chain hydrocarbon-substituted phenol with from about 1 to about 2.5 moles of formaldehyde and from about 0.5 to about 2 moles of polyalkylene polyamine.

The dispersant systems herein include at least two different dispersants. At least one of the dispersants described herein may be borated and/or phosphorylated and, preferably, only the dispersant having the longer chain polyisobutenyl moiety is borated and phosphorylated. These dispersants are generally the reaction products of i) at least one phosphorus compound and/or a boron compound and ii) at least one ashless dispersant.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithiophosphorous acid; trihydrocarbyl phosphine oxide; trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$) acid, phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4S_{10}$) can also be used in forming dispersants for this disclosure. Also usable, are the inorganic phosphorus halide compounds such as $PCl_3$, $PBr_3$, $POCl_3$, $PSCl_3$, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary".$R_2P(O)(OR)$), esters of phosphinic acids, phosphonyl halides (e.g., $RP(\mathbf{0})Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, preferably up to about 50 carbon atoms, more preferably up to about 24 carbon atoms, and most preferably up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

As discussed above, the dispersant system of the lubricating and cooling fluids described herein include at least two dispersants, (i) one obtained from a polyisobutylene having a relatively high number average molecular weight and (ii) the other obtained from a polyisobutylene having a relatively lower number average molecular weight. The amounts of the two dispersants and the provision of phosphorus and boron are balanced relative to dispersant amounts and dispersant polyisobutylene moieties to improve lubricant electric conductivity and maintain suitable wear and friction performance.

In one embodiment, the first dispersant used in the dispersant system includes a polyisobutenyl moiety having a number average molecular weight in the range from about 1500 to about 2500 and is present in the lubricating and cooling fluid in an amount sufficient to deliver greater than about 300 ppm nitrogen, greater than about 400 ppm nitrogen, about 300 to about 700 ppm nitrogen, about 450 to about 500 ppm nitrogen, or up to about 600 ppm, or up to about 500 ppm nitrogen (or other ranges therewithin).

The first dispersant may be borated and/or phosphorylated. Accordingly, in one embodiment, the first dispersant has a boron content from about 0.25 to about 0.5 wt %, a phosphorus content from about 0.5 to about 1 wt % phosphorus, and a nitrogen content from about 1.5 to about 2 wt % nitrogen. In another embodiment, the first dispersant has a boron content of from about 0.3 to about 0.4 wt %, a phosphorus content of from about 0.65 to about 0.8 wt % phosphorus, and a nitrogen content of rom about 1.7 to about 1.8 wt % nitrogen. In some cases, the first dispersant is borated and phosphorylated and has a boron plus phosphorus to nitrogen ((B+P)/N) weight ratio of from 0:1 to about 0.8:1, or from about 0.6:1 to about 0.7:1, or from about 0.6:1 to about 0.60:1 to about 0.65:1.

In one embodiment, the first dispersant of the dispersant system is borated and phosphorylated and is present in the lubricating and cooling fluid an amount sufficient to deliver less than about 125 ppm boron, less than about 300 ppm phosphorus, less than about 500 ppm nitrogen, or less than about 700 ppm. In another embodiment, the first dispersant is borated and phosphorylated and is present in the lubricating and cooling fluid an amount sufficient to deliver less than about 100 ppm boron, less than about 250 ppm phosphorus, and less than about 700 ppm nitrogen. In yet another embodiment, first dispersant is borated and phosphorylated and is present in the lubricating and cooling fluid in an amount sufficient to deliver about 80 to about 100 ppm boron, about 200 to about 250 ppm phosphorus, and about 450 ppm to about 700 ppm of nitrogen or any other range of such elements between the amounts noted herein.

The second dispersant used in the dispersant system includes a polyisobutenyl moiety having a number average molecular weight less than about 1000, or about 500 to about 1000, and is present in the lubricating and cooling fluid an amount sufficient to deliver less than about 150 ppm nitrogen, or less than about 130 ppm nitrogen, less than about 115 ppm nitrogen, less than 110 ppm nitrogen, less than about 100 ppm nitrogen, or less than 50 ppm nitrogen. In other approaches, the second dispersant includes, more than about 10 ppm nitrogen, more than about, 20ppm nitrogen, more than 30 ppm nitrogen, more than about 50 ppm nitrogen, or more than about 80 ppm nitrogen (or any other ranges of such amounts herein). In embodiments herein, the second dispersant is preferably not borated and/or phosphorylated and does not provide such elements to the fluid.

As shown in the examples herein, when the first dispersant having a relatively high molecular weight is present in the lubricating and cooling fluid in an amount to deliver less than about 125 ppm boron, less than about 300 ppm phosphorus, and less than about 700 ppm nitrogen (or other ranges noted above) and combined with the second dispersant in the lubricating and cooling fluid in an amount to deliver less than about 150 ppm nitrogen (or other ranges noted above) and no boron or phosphorus, the resulting composition has decreased electric conductivity and maintain suitable wear and friction performance. If a single dispersant having a relatively low molecular weight is used to deliver boron and/or phosphorus to the lubricating and cooling fluid, the resulting composition has increased electric conductivity.

In yet other approaches or embodiments, the combined dispersant system of the fluids herein is balanced to provide high levels of boron and phosphorus relative to the total molecular weight of the combined polyisobutenyl moiety within the dispersant system. For instance, unexpectedly good conductivity was achieved when at least one of the first dispersant and the second dispersant is borated and phosphorylated such that a total amount of boron and phosphorus in the dispersant system relative to the nitrogen in the dispersant system is from about 0.5 to about 0.7 and wherein the first and second dispersants deliver up to about 100 ppm of total boron and phosphorus per 1000 number average molecular weight of the combined polyisobutylene moieties used in the dispersant system.

Such unique dispersant system combination unexpectedly achieves low conductivity together with the other desired fluid performance characteristics. FIG. 1, as explained further in the Examples below, shows the dramatic effect of such dispersant system on the conductivity of the fluids herein.

The Friction Modifier System:

The lubricating and cooling fluid described herein also contains a friction modifier system comprising at least two friction modifiers, such as an alkoxylated aliphatic amine and ether amine in specific amounts to provide suitable friction performance and decreased electrical conductivity.

The alkoxylated aliphatic amine useful in the present invention include, but are not limited to bis[2-hydroxyethyl]-coco-amine, polyoxyethylene cocoamine, (bis[2-hydroxyethyl] soyamine, bis[2-hydroxyethyl]allow-amine, polyoxyethylene-tallowamine, bis[2-hydroxyethyl] oleylamine, bis[2-hydroxyethyl]octadecylamine, and polyoxyethylene octadecylamine. In one embodiment, the alkoxylated aliphatic amine is a di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 16 to about 25 carbon atoms. The alkoxylated aliphatic amine may be present in the lubricating and cooling fluid in an amount sufficient to deliver up to about 20 ppm nitrogen, or up to about 15 ppm of nitrogen.

The ether amine useful in the present invention include primary ether amines and ether diamines. More specifically, these can include but are not limited to one or more of: isohexyloxypropylamine, 2-ethylhexyloxypropylamine, octyl/decyloxypropylamine, isodecyloxypropylamine, isododecyloxypropylamine, isotridecyloxypropylamine, $C_{12-15}$ alkyloxypropylamine, isodecyloxypropyl-1,3-diaminopropane, isododecyloxypropyl-1,3-diaminopropane, Isotridecyloxypropyl-1,3-diaminopropane, isohexyloxypropylamine, 2-ethylhexyloxypropylamine, octyl/decyloxypropylamine, isodecyloxypropylamine, isopropyloxypropylamine, tetradecyloxypropylamine, dodecyl/tetradecyloxypropylamine, tetradecyl/dodecyloxypropylamine, octadecyl/hexadecyloxypropylamine. The ether amine may be present in the lubricating and cooling fluid in an amount sufficient to deliver up to about 20 ppm nitrogen, or up to about 15 ppm of nitrogen.

In one embodiment, the alkoxylated aliphatic amine and ether amine may be present in the lubricating and cooling fluid in an amount sufficient to deliver up to about 40 ppm of nitrogen, or up to about 30 ppm of nitrogen. In another embodiment, the alkoxylated aliphatic amine is a di(hydroxyalkyl) aliphatic tertiary amine and the ether amine is isodecyloxy-propylamine and the combination of both amines is present in an amount sufficient deliver up to about 40 ppm of nitrogen, or up to about 30ppm of nitrogen.

In another embodiment, the lubricating and cooling fluid described herein further comprises an optional third friction modifier, such as a fatty diamine. Examples of suitable fatty diamines are mono- or dialkyl, symmetrical or asymmetrical ethylenediamines, propanediamines (1, 2, or 1,3), and polyamine analogs of the above, n-coco-1,3-diaminopropane, n-soya-1,3-diaminopropane, n-tallow-1,3-diaminopropane, and n-oleyl-1,3-diaminopropane. The fatty diamine may be present in the lubricating and cooling fluid in an amount sufficient to deliver up to about 5 ppm nitrogen or up to about 3 ppm of nitrogen.

In one embodiment, the lubricating and cooling fluid described herein includes an alkoxylated aliphatic amine, an ether amine, and a fatty diamine and the combination of these components may be present in the lubricating and cooling fluid in an amount sufficient to deliver up to about 30 ppm of nitrogen. In another embodiment, the lubricating and cooling fluid includes a di(hydroxyalkyl) aliphatic tertiary amine, isodecyloxypropylamine, n-oleyl-1,3-diaminopropane and the combination of these compounds present in an amount sufficient deliver up to about 30 ppm of nitrogen.

Other Additives

The lubricating and cooling fluid described herein may also include other additives of the type used in transmission fluid compositions in addition to the components described above. Such additives include, but are not limited to, antioxidant(s), viscosity modifier(s), phosphorus-containing components, detergent(s), corrosion inhibitor(s), antirust additives, antifoam agent(s), demulsifier(s), pour point depressant(s), seal swell agent(s), and additional dispersant(s), additional friction modifier(s), and additional sulfur-containing component(s).

Antioxidants:

In some embodiments, the lubricating and cooling fluid contains one more antioxidants. Suitable antioxidants include phenolic antioxidants, aromatic amine antioxidants, sulfur containing antioxidants, and organic phosphites, among others.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol), N,N'-di-sec-butyl-phenylenediamine, 4-iisopropylaminodiphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

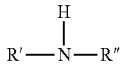

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenyl amine, p-oriented styrenated diphenylamine, mixed butyloctyldi-phenylamine, and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any C4 to C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating and cooling fluid described herein may be present in an amount to deliver up to about 200 ppm nitrogen, or up to about 100 ppm nitrogen, or up to about 150 ppm nitrogen, or about 100 to about 150 ppm nitrogen.

Additional Friction Modifiers:

In some embodiments, the lubricating and cooling fluid contains additional friction modifiers other than those contained in the friction modifier system described above. Suitable additional friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and such hydrocarbyl groups may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivative, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

If the additional friction modifiers contain nitrogen, such additional friction modifiers may be present in the lubricating and cooling fluid in an amount to deliver up to about 200 ppm nitrogen, or up to about 150 ppm nitrogen, or about 100 to about 150 ppm nitrogen.

Detergents:

Metal detergents that may be included in the lubricating and cooling fluid described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, such as from 150 to 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in the lubricating and cooling fluid in an amount sufficient to improve the anti-rust performance of the fluid. The metal-containing detergent may be present in the fluid in an amount sufficient to provide up to 300 ppm alkali and/or alkaline earth metal based on a total weight of the lubricating and cooling fluid. In one example, the metal-containing detergent may be present in an amount sufficient to provide from about 100 to about 300 ppm alkali and/or alkaline earth metal. In another embodiment, the metal-containing detergent may be present in an amount sufficient to provide from about 220 to about 250 ppm alkali and/or alkaline earth metal.

Corrostion Inhibitors:

Rust or corrosion inhibitors may also be included in the lubricating compositions described herein. Such materials include monocarboxylic acids and polycarboxylic acids. Examples of suitable monocarboxylic acids are octanoic acid, decanoic acid and dodecanoic acid. Suitable polycarboxylic acids include dimer and trimer acids such as are produced from such acids as tall oil fatty acids, oleic acid, linoleic acid, or the like.

Another useful type of rust inhibitor may be alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable rust or corrosion inhibitors include ether amines, acid phosphates, amines, polyethoxylated compounds such as ethoxylated amines, ethoxylated phenols, and ethoxylated alcohols, imidazolines, aminosuccinic acids or derivatives thereof, and the like. Mixtures of such rust or corrosion inhibitors may be used. The total amount of corrosion inhibitor, when present in the lubricating composition described herein may range up to 2.0 wt % or from 0.01 to 1.0 wt % based on the total weight of the lubricating composition.

Viscosity Modifiers:

The lubricating and cooling fluid may optionally contain one or more viscosity modifiers. Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in U.S. Publication No. 2012/0101017 A1.

The lubricating and cooling fluid described herein also may optionally contain one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or dispersant viscosity modifier, when present, may be up to about 1.0 wt %, or up to about 0.5 wt %, or up to about 0.3 wt % based on the total weight of the lubricating and cooling fluid.

Demulsifiers:

Demulsifiers include trialkyl phosphates, and various polymers and copolymers of ethylene glycol, ethylene oxide, propylene oxide, or mixtures thereof, including polyethylene oxides, polypropylene oxides and (ethylene oxide-propylene oxide) polymers. When present, the amount of demulsifier in the lubricating and cooling fluid may be up about 0.05 wt, or up to about 0.02 wt %, or below about 0.015 wt % based on the total weight of the lubricating and cooling fluid.

Antifoam Agents:

Antifoam agents used to reduce or prevent the formation of stable foam include silicones, polyacrylates, or organic polymers. Foam inhibitors that may be useful in the compositions of the disclosed invention include polysiloxanes, copolymers of ethyl acrylate and 2-ethylhexylacrylate and optionally vinyl acetate. When present, the amount of antifoam in the lubricating and cooling fluid may be up about 0.1 wt, or up to about 0.08 wt %, or below about 0.07wt % based on the total weight of the lubricating and cooling fluid.

Pour Point Depressants:

The lubricating and cooling fluid may optionally contain one or more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from about 0.001 wt % to about 0.04 wt %, based upon the total weight of the lubricating and cooling fluid.

In general terms, a lubricating and cooling fluid described herein may include additive components in the ranges listed in Table 2.

TABLE 2

| Component | Wt % (Suitable Embodiments) | Wt % (Preferred Embodiments) |
|---|---|---|
| Dispersant System | 3.0-8.0 | 5.0-7.0 |
| Sulfurized Component | 0.05-1.5 | 0.5-1.0 |
| Friction Modifier System | 0.3-0.7 | 0.4-0.6 |
| Detergent(s) | 0.05-0.5 | 0.1-0.3 |
| Antioxidant(s) | 0.1-0.6 | 0.3-0.5 |
| Antifoaming agent(s) | 0-0.05 | 0.1-0.04 |
| Viscosity index improver(s) | 0-7.0 | 0-5.0 |
| Base oil(s) | Balance | Balance |
| Total | 100 | 100 |

The percentages of each component above represent the weight percent of each component, based upon the total weight of the lubricating and cooling fluid containing the recited component. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

Electric motor systems including a single fluid that provides not only lubrication to gears, clutches, and other mechanical parts but also cooling to the electric motor should provide good wear and friction performance, low copper corrosion, and relatively low electrical conductivity. However, the elevated temperatures in the electric motor pose challenges for developing this type of fluid. In the sump of the electric motor, the lubricating and cooling fluid can reach temperatures greater than about 70° C. or greater than about 100° C. and, in some instances, about 70° C. to about 125° C. Likewise, the temperature of the copper windings in the stator of the motor may reach at least about 150° C., and in some instances up to 180° C. Additives that provide elements like sulfur, boron, or phosphorus to achieve good wear performance, but can lead to excessive copper corrosion and higher conductivity. Moreover, these negative effects are exacerbated at higher temperatures. Thus, it was unexpected that the combination of selected additives providing amounts of sulfur, phosphorus, and boron herein provided acceptable wear and friction performance while also providing low copper corrosion and low conductivity at elevated temperatures.

EXAMPLES

The following non-limiting examples illustrate the features and advantages of one or more embodiments of the disclosure. To demonstrate how the sulfurized component, dispersant system, and friction modifier systems affected the wear, oxidation, copper compatibility, and conductivity of the fluid, exemplary finished fluids were formulated and tested. The formulations were evaluated in the FZG Scuffing Test, DKA Oxidation Test, a copper corrosion test, and measured for initial electrical conductivity.

FZG Scuffing Test is wear test used to evaluate the scuffing load capacity of lubricants and is performed according to ASTM D5182-97 (2014). Results are reported in load stage pass, and better results are obtained for samples with a higher load stage pass.

DKA Oxidation Test is carried out according to the CEC L-48-A-00 with operating conditions of 170° C. or 180° C. for 192 hours. The results obtained are the percentage increase in kinematic viscosity at 100° C. Lower values suggest improved performance.

It is beneficial for electric motor fluids to exhibit low conductivity, and thus act somewhat as an insulator. The conductivity of fluids was measured according to a modified version of ASTM D2624-15 (testing of a lubricant, rather than of a fuel using a Flucon Epsilon+ at 1.5 V).

The copper corrosion test is a modified version of ASTM D130-18 in which copper strips are immersed in the lubricant at 150° C. for 504 hours. At the end of the test, the oil was evaluated for levels of copper. Higher levels of copper in the oil indicate the corrosiveness of the lubricant to copper.

The formulations were also tested for thermal conductivity to ensure they exhibit appropriate cooling ability. The thermal conductivity of each formulation was measured at 100° C. using one measurement according to ASTM D7896-14 and all formulations exhibited a thermal conductivity between 126 and 136 mW/(m-K), and thus had suitable cooling ability.

The formulations tested in Table 3 below all contained the same additive base pack containing antioxidant, friction modifiers, antifoam and demulsifier. The formulations also contained varying amounts of sulfurized components, additional friction modifiers, dispersants, and base oil as set forth in Table 3. The formulations were tested in a broad range of base oils to obtain finished fluids having kinematic viscosities at 100° C. of between 4.10 and 4.33 cSt. The inventive formulations contain similar additives to the comparative formulations but balanced the delivery of sulfur, friction modifiers and dispersants differently to achieve surprisingly improved wear, oxidation stability, copper compatibility, and low conductivity even with high levels of sulfur, boron, and phosphorus not expected to perform in the context of lubricants for electric motor systems. Details of these components are described below:

Sulfur Component S-1: 2,5-dimercapto-1,3,4-thiadiazole and hydrocarbyl-substituted derivatives thereof containing approximately 35 wt % sulfur, which was a 75:25 to 85:15 mixture of 2,5-bis-(nonyldithio)-1,3,4-thiadiazole and 2,5-mono-(nonyldithio)-1,3,4-thiadiazole.

Sulfur Component S-2: sulfurized synthetic sperm oil comprised of sulfurized transesterified triglycerides containing approximately 6.75 wt % sulfur.

Friction Modifier FM-1: di(hydroxyalkyl) aliphatic tertiary amine in which the hydroxyalkyl groups each contain from 2 to about 4 carbon atoms, and the aliphatic group is an acyclic hydrocarbyl group containing from about 16 to about 25 carbon atoms; the di(hydroxyalkyl) aliphatic tertiary amine contains approximately 4 wt % nitrogen.

Friction Modifier FM-2: isodecyloxypropylamine containing approximately 6.1 wt % nitrogen.

Friction Modifier FM-3: n-oleyl-1,3-diaminopropane containing approximately 7 wt % nitrogen.

Dispersant D-1: phosphorylated and borated succinimide dispersant made from a 950 Mn polyisobutylene, maleic anhydride, a mixture of polyalkylene polyamines having an average of 6.5 nitrogen atoms per molecule, phosphorous acid, and boric acid. This dispersant has approximately 0.76 wt % phosphorus, approximately 0.35 wt % boron, and approximately 1.75% nitrogen.

Dispersant D-2: phosphorylated and borated succinimide dispersant obtained from a 2300 Mn polyisobutylene, maleic anhydride, a mixture of polyalkylene polyamines having an average of 6.5 nitrogen atoms per molecule, phosphorous acid, and boric acid. The dispersant had approximately 0.77 wt % nitrogen, 0.15 wt % boron, and 0.35 wt % phosphorus.

Dispersant D-3: succinimide dispersant obtained from 950 Mn polyisobutylene, maleic anhydride, and a mixture of polyalkylene polyamines having an average of 6.5 nitrogen atoms per molecule. The dispersant has approximately 2.1 wt % nitrogen.

Base Oils: Group IV base oils included a mixture of polyalphaolefin (PAO) base oils having a kV100 of approximately 2 cSt and approximately 4 cSt oils to achieve finished fluid viscosity targets. Group III base oils included a mixture oils having approximately 3 cSt and approximately 4 cSt oils to achieve finished fluid viscosity targets.

tion compared to the comparative examples that delivered too little or too much sulfur from the first sulfurized component and/or delivered too much sulfur from the second sulfurized component.

In both the inventive and comparative formulations, the friction modifier system comprised the following friction modifiers: alkoxylated aliphatic amine, ether amine, and fatty diamine. The inventive formulations contain these components in amounts to provide suitable friction performance and decreased electrical conductivity.

In the comparative formulations, the dispersant system included one phosphorylated and borated succinimide dispersant obtained from 950 MW polyisobutylene. In the inventive samples, the dispersant system included two dispersants. The first dispersant was a phosphorylated and borated succinimide dispersant obtained from 2300 Mn polyisobutylene. The second dispersant was a succinimide dispersant obtained from 950 Mn polyisobutylene. Without being bound by any particular theory, it is believed that the inclusion of the first and second dispersants in the inventive formulations improves lubricant conductivity and maintains suitable wear and friction performance. The surprising effect of the dispersant system is shown in Tables 4 and 5 and FIG. 1 with a ratio of boron and phosphorus relative to the total molecular weight of the polyisobutylene chains in the dispersant system.

TABLE 3

| Fluid Compositions | | | | | | |
|---|---|---|---|---|---|---|
| | Inv 1 | Comp 1 | Inv 2 | Comp 2 | Comp 3 | Inv 3 |
| S-1 (wt %) | 0.35 | 0.25 | 0.35 | 0.25 | 0.50 | 0.35 |
| S-2 (wt %) | 0.40 | 0.50 | 0.40 | 0.50 | 0.50 | — |
| FM-1 (wt %) | 0.03 | 0.06 | 0.03 | 0.06 | 0.06 | 0.03 |
| FM-2 (wt %) | 0.02 | 0.05 | 0.02 | 0.05 | 0.05 | 0.02 |
| FM-3 (wt %) | 0.004 | 0.005 | 0.004 | 0.005 | 0.005 | 0.004 |
| D-1 (wt %) | — | 4.30 | — | 4.30 | 4.30 | — |
| D-2 (wt %) | 6 | — | 6 | — | — | 6 |
| D-3 (wt %) | 0.5 | — | 0.5 | — | — | 0.5 |
| Calcium sulfonate detergent | 0.18 | 0.20 | 0.18 | 0.20 | 0.20 | 0.18 |
| Ethoxylated alcohol surfactant | — | 0.05 | — | 0.05 | — | — |
| Antifoam | 0.03 | 0.05 | 0.03 | 0.05 | 0.05 | 0.05 |
| Process Oil | 1.376 | 1.225 | 1.376 | 1.225 | 1.225 | 1.756 |
| Trialkyl phosphate anti-wear | — | — | — | — | 0.70 | — |
| Viscosity Modifier | — | — | — | — | 0.5 | — |
| Diisooctyladipate | 5 | 5 | 5 | 5 | — | 5 |
| Base Pack | 0.91 | 0.91 | 0.91 | 0.91 | 0.91 | 0.91 |
| Group IV Base Oil | 85.2 | 87.4 | — | — | — | 85.2 |
| Group III Base Oil | — | — | 85.2 | 87.4 | 91 | — |
| kV 100, cSt | 4.33 | 4.24 | 4.25 | 4.11 | 4.21 | 4.31 |

All the inventive formulations contain the first sulfurized component, in this case, 2,5-dimercapto-1,3,4-thiadiazole and hydrocarbyl-substituted derivatives thereof, at a treat rate to deliver between 1000 ppm-1500 pm sulfer to the lubricant. Two of the inventive formulations also contained the optional second sulfurized component, in this case, sulfurized synthetic sperm oil, in an amount up to 300 ppm sulfur to the lubricant. All inventive examples exhibited improved wear performance and improved copper protec- FIG. 1 shows the improvement of inventive samples over comparative samples in the context of how the dispersant system boron and phosphorus are provided relative to the number average molecular weight of total polyisobutylene moiety or moieties in the dispersant system. Surprisingly, this factor exhibits an effect on conductivity with inventive samples showing a much lower conductivity suitable for fluids for electric motor systems.

TABLE 4

| Calculated Elemental Analysis of Fluids | Inv 1 | Comp 1 | Inv 2 | Comp 2 | Comp 3 | Inv 3 |
|---|---|---|---|---|---|---|
| S-1, ppm Sulfur | 1225 | 875 | 1225 | 875 | 1750 | 1225 |
| S-2, ppm Sulfur | 270 | 338 | 270 | 338 | 338 | — |
| Total Sulfur from S-1 and S-2, ppm | 1495 | 1213 | 1495 | 1213 | 2088 | 1225 |
| FM-1, ppm Nitrogen | 12 | 24 | 12 | 24 | 24 | 12 |
| FM-2, ppm Nitrogen | 12 | 30.5 | 12 | 30.5 | 305 | 12 |
| FM-3, ppm Nitrogen | 2.8 | 3.5 | 2.8 | 3.5 | 3.5 | 2.8 |
| Total Nitrogen from FM-1, FM-2, and FM-3, ppm | 26.8 | 61.5 | 26.8 | 61.5 | 332.5 | 26.8 |
| D-1, ppm Nitrogen | — | 752.5 | — | 752.5 | 752.5 | — |
| D-2, ppm Nitrogen | 462 | — | 462 | — | — | 462 |
| D-3, ppm Nitrogen | 105 | — | 105 | — | — | 105 |
| Boron from Dispersant system, ppm | 90 | 150 | 90 | 150 | 150 | 90 |
| Phosphorus from Dispersant system, ppm | 210 | 326.8 | 210 | 326.8 | 326.8 | 210 |
| Nitrogen from Dispersant system, ppm | 567 | 752.5 | 567 | 752.5 | 752.5 | 567 |
| (B + P)/N from Dispersant System | 0.53 | 0.63 | 0.53 | 0.63 | 0.63 | 0.53 |
| Mn per 1000 molecular weight of the combined polyisobutylenes used to obtain the dispersants in the dispersant system * | 3.25 | 0.95 | 3.25 | 0.95 | 0.95 | 3.25 |
| (B + P)/1000 Mn of the combined polyisobutylenes used to obtain the dispersants in the Dispersant system ** | 92.3 | 501.9 | 92.3 | 501.9 | 501.9 | 92.3 |

* Inv 1 has 3.25 Mn per 1000 molecular weight of the combined polyisobutylenes used to obtain the dispersants in the dispersant system, calculated from the 2300 Mn PIB of Dispersant 2 plus the 950 Mn PIB of Dispersant 3 divided by 1000 or (2300 + 950)/1000. (Other examples are calculated in the same manner.)
** Inv 1 has a ratio of 92.3 calculated by adding the 90 ppm of boron and 210 ppm of phosphorus divided by the 3.25 Mn per 1000 molecular weight of the combined polyisobutylenes used to obtain the dispersants in the dispersant system or (210 + 90)/3.25. (Other examples are calculated in the same manner.)

TABLE 5

| Fluid Performance | Inv 1 | Comp 1 | Inv2 | Comp 2 | Comp 3 | Inv 3 |
|---|---|---|---|---|---|---|
| FZG, LSF | 8 | 5 | 8 | 5 | 7 | 7 |
| DKA Oxidation, 170° C., 192 h, ΔkV at 100° C. | 0.25 | 0.54 | 0.13 | 0.38 | 1.67 | 0.091 |
| DKA Oxidation 180° C., 192 h, ΔkV at 100° C. | 1.57 | 26.96 | 1.50 | 34.24 | | 0.391 |
| Initial Electrical Conductivity, nS/m, 20 Hz, 100° C. | 55 | 123 | 57 | 124 | 127 | 55 |
| Extended D130 Cu, 3-Weeks at 150° C., ppm | 80 | 134 | 81 | 132 | 442 | 67 |

It is to be understood that while the lubricating composition and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, sub stituent or parameter disclosed in the description or an example is to be interpreted as a disclosure of either a lower or an upper limit of a range and thus can be combined with any other lower or upper limit of a range or specific amount/value for the same component, compound, sub stituent or parameter disclosed elsewhere in the application to form a range for that component, compound, sub stituent or parameter.

What is claimed is:

1. A method for lubricating gears and clutches in an electric motor system, wherein the electric motor system comprises a sump, copper windings in a stator, gears and clutches, and simultaneously cooling a motor thereof, the method comprising:

operating an electric motor system, containing a lubricating and cooling fluid, such that a temperature of the lubricating and cooling fluid in a sump of the electric motor system is between 70° C. and 125° C. and the temperature of copper windings in a stator of the electric motor system is between 150° C. and 180° C.;

lubricating gears and clutches in the electric motor system with the lubricating and cooling fluid and simultaneously cooling the motor in the electric motor system by contacting the copper windings with the lubricating and cooling fluid; and wherein the lubricating and cooling fluid comprises:

an oil of lubricating viscosity comprises an API Group III base oil, API Group IV base oil, or mixtures thereof;

at least one thiadiazole or hydrocarbyl-substituted derivatives thereof delivering about 1000 to about 1500 ppm sulfur to the lubricating and cooling fluid;

a dispersant system including comprising (1) a first dispersant obtained from polyisobutylene having a number average molecular weight of about 1500 to about 2500 and delivering up to about 700 ppm nitrogen to the lubricating and cooling fluid and (i1) a second dispersant having a number average molecular weight of about 1000 or less and delivering up to about 150 ppm nitrogen to the lubricating and cooling fluid;

an alkoxylated aliphatic amine delivering up to about 20 ppm nitrogen to the lubricating and cooling fluid;

an ether amine delivering up to about 20 ppm nitrogen to the lubricating and cooling fluid; and wherein at least one of the first dispersant and the second dispersant is borated and phosphorylated such that a total amount of boron and phosphorus in the dispersant system relative to the nitrogen in the dispersant system is from about 0.5 to about 0.7 and wherein the first and second dispersants deliver up to about 100 ppm of total boron and phosphorus per 1000 number average molecular weight of the combined polyisobutylene moieties used in the dispersant system. first and second dispersants deliver up to about 100 ppm of total boron and phosphorus per 1000 number average molecular weight of the combined polyisobutylene moieties used in the dispersant system.

2. The method of claim 1, where the at least one thiadiazole or hydrocarbyl-substituted derivatives thereof includes one or more compounds having a structure of Formula I:

(Formula I)

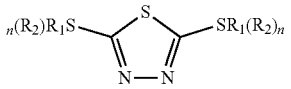

wherein each $R_1$ i is independently hydrogen or sulfur;

each $R_2$ is independently an alkyl group;

n is an integer of 0 or 1 and if $R_1$ is hydrogen then the integer n of the adjacent $R_2$ moiety is 0 and if $R_1$ is sulfur then the n of the adjacent $R_2$ moiety is 1; and wherein at least one $R_l$ is sulfur.

3. The method of claim 2, wherein the at least one thiadiazole or hydrocarbyl-substituted derivatives thereof is a thiadiazole mixture of 2,5-bis-(nonyldithio)-1,3,4-thiadiazole, and 2,5-mono-(nonyldithio)-1,3,4-thiadiazole.

4. The method of claim 1, wherein the lubricating and cooling fluid further comprises a fatty diamine delivering up to about 3 ppm nitrogen to the lubricating and cooling fluid.

5. The method of claim 4, wherein the combination of the alkoxylated aliphatic amine, the ether amine, and the fatty diamine deliver nitrogen in amounts of about 30 ppm or less nitrogen to the lubricating and cooling fluid.

6. The method of claim 5, wherein the alkoxylated aliphatic amine is a di(hydroxyalkyl) aliphatic tertiary amine comprising hydroxyalkyl groups each containing from 2 to 4 carbon atoms, and further comprising an acyclic hydrocarbyl group containing from 16 to 25 carbon atoms.

7. The method of claim 6, wherein the ether amine comprises isodecyloxypropylamine.

8. The method of claim 7, wherein the fatty diamine comprises n-oleyl-1,3-diaminopropane.

9. The method of claim 5, wherein the lubricating and cooling fluid further comprises a sulfurized ester delivering about 300 ppm or less sulfur and wherein the alkoxylated aliphatic amine and the ether amine each deliver up to about 15 ppm nitrogen to the lubricating and cooling fluid and wherein the at least one thiadiazole or hydrocarbyl-substituted derivatives thereof is a thiadiazole mixture of 2,5-bis-(nonyldithio)-1,3,4-thiadiazole, and 2,5-mono-(nonyldithio)-1,3,4-thiadiazole, and wherein the combination of the thiadiazole mixture and the sulfurized ester deliver about 1400 to about 1800 ppm sulfur to the lubricating and cooling fluid.

10. The method of claim 1, wherein the first dispersant is present in an amount to deliver up to about 500 ppm nitrogen to the lubricating and cooling fluid.

11. The method of claim 10, wherein the second dispersant is present in an amount to deliver up to about 115 ppm nitrogen to the lubricating and cooling fluid.

12. The method of claim 11, wherein the first dispersant is obtained from polyisobutylene having a number average molecular weight of about 2000 to about 2400 and the second dispersant is obtained from polyisobutylene having a number average molecular weight of about 950.

13. The method of claim 12, wherein the first dispersant delivers boron and phosphorus in amounts of about 100 ppm or less boron and about 250 ppm or less phosphorus to the lubricating and cooling fluid.

14. The method of claim 1, wherein the oil of lubricating viscosity includes the Group III base oil.

15. The method of claim 1, wherein the oil of lubricating viscosity includes a gas-to-liquid (GTL) base oil.

16. The method of claim 1, wherein the oil of lubricating viscosity includes a polyalphaolefin (PAO) base oil.

17. The method of claim 1, wherein the lubricating fluid has an initial electrical conductivity of about 60 nS/M or less, as measured by a modified ASTM D2624-15 using the lubricating and cooling fluid at 20 Hz and at 100° C.

18. The method of claim 1, wherein the lubricating and cooling fluid further comprises a sulfurized ester delivering about 180 to about 300 ppm sulfur to the lubricating and cooling fluid.

19. The method of claim 18, wherein the combination of the at least one thiadiazole or hydrocarbyl-substituted derivatives thereof and the sulfurized ester deliver about 1400 to about 1800 ppm sulfur to the lubricating and cooling fluid.

20. The method of claim 18, wherein the sulfurized ester comprises sulfurized transesterified triglycerides.

21. A lubricating and cooling fluid for an electric motor system , wherein the electric motor system comprises a sump, copper windings in a stator, gears and clutches, the lubricating and cooling fluid comprising:

a majority base oil of lubricating viscosity comprising an API Group III base oil, an API Group IV base oil, or mixtures thereof;

at least one thiadiazole or hydrocarbyl-substituted derivatives thereof delivering about 1000 to about 1500 ppm sulfur to the lubricating and cooling fluid;

a dispersant system comprising (i) a first dispersant obtained from polyisobutylene having a number average molecular weight of about 1500 to about 2500 and delivering nitrogen in amounts of about 700 ppm or less nitrogen to the lubricating and cooling fluid and (ii) a second dispersant obtained from polyisobutylene having a number average molecular weight of about 1000 or less and delivering nitrogen in amounts of about 150 ppm or less nitrogen to the lubricating and cooling fluid;

an alkoxylated aliphatic amine delivering up to about 20 ppm nitrogen to the lubricating and cooling fluid;

an ether amine delivering up to about 20 ppm nitrogen to the lubricating and cooling fluid;

wherein at least one of the first dispersant and the second dispersant is borated and phosphorylated such that a total amount of boron and phosphorus in the dispersant system relative to the nitrogen in the dispersant system is from about 0.5 to about 0.7 and wherein the first and second dispersants deliver up to about 100 ppm of total boron and phosphorus per 1000 number average molecular weight of the combined polyisobutylene moieties used in the dispersant system;

wherein the lubricating and cooling fluid has an electrical conductivity of 60 nS/M or less, as measured by ASTM D2624-15 at 20 Hz and at 100° C.

22. The lubricating and cooling fluid of claim 21, where the at least one thiadiazole or hydrocarbyl-substituted derivatives thereof includes one or more compounds having a structure of Formula I:

(Formula I)

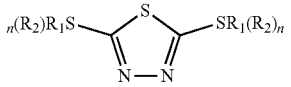

wherein each $R_1$ is independently hydrogen or sulfur;

each $R_2$ is independently an alkyl group;

n is an integer of 0 or 1 and if $R_1$ is hydrogen then the integer n of the adjacent $R_2$ moiety is 0 and if $R_1$ is sulfur then the n of the adjacent $R_2$ moiety is 1; and wherein at least one $R_l$ is sulfur.

23. The lubricating and cooling fluid of claim 21, wherein the at least one thiadiazole or hydrocarbyl-substituted derivatives thereof comprises a thiadiazole mixture of 2,5-bis-(nonyldithio)-1,3,4-thiadiazole, and 2,5-mono-(nonyldithio)-1,3,4-thiadiazole.

24. The lubricating and cooling fluid of claim 21 wherein the fluid further comprises a fatty diamine delivering up to about 3 ppm nitrogen to the lubricating and cooling fluid.

25. The lubricating and cooling fluid of claim 24, wherein the combination of the alkoxylated aliphatic amine, the ether amine, and the fatty diamine deliver up to about 30 ppm of nitrogen to the lubricating and cooling fluid.

26. The lubricating and cooling fluid of claim 25, wherein alkoxylated aliphatic amine is a di(hydroxyalkyl) aliphatic tertiary amine comprising hydroxyalkyl groups each containing from 2 to 4 carbon atoms, and further comprising an acyclic hydrocarbyl group containing from 16 to 25 carbon atoms.

27. The lubricating and cooling fluid of claim 26, wherein the ether amine is isodecyloxypropylamine.

28. The lubricating and cooling fluid of claim 27, wherein the fatty diamine is n-oleyl-1,3-diaminopropane.

29. The lubricating and cooling fluid of claim 25, further comprising a sulfurized ester delivering about 300 ppm or less sulfur to the lubricating and cooling fluid and wherein the alkoxylated aliphatic amine and ether amine each deliver up to about 15 ppm nitrogen to the lubricating and cooling fluid and wherein the at least one thiadiazole or hydrocarbyl-substituted derivatives thereof is a thiadiazole mixture of 2,5-bis-(nonyldithio)-1,3,4-thiadiazole and 2,5-mono-(nonyldithio)-1,3,4-thiadiazole and wherein the combination of the thiadiazole mixture and the sulfurized ester deliver about 1400 to about 1800 ppm sulfur to the lubricating and cooling fluid.

30. The lubricating and cooling fluid of claim 21, wherein the first dispersant is present in an amount to deliver up to about 500 ppm nitrogen to the lubricating and cooling fluid.

31. The lubricating and cooling fluid of claim 30, wherein the second dispersant is present in an amount to deliver up to about 115 ppm nitrogen to the lubricating and cooling fluid.

32. The lubricating and cooling fluid of claim 31, wherein the first dispersant is obtained from polyisobutylene having a number average molecular weight of about 2000 to about 2400 and the second dispersant is obtained from polyisobutylene having a number average molecular weight of about 950.

33. The lubricating and cooling fluid of claim 32, wherein the first dispersant delivers boron and phosphorus in amounts of about 100 ppm or less boron and about 250 ppm or less phosphorus to the lubricating fluid.

34. The lubricating and cooling fluid of claim 21, wherein the first dispersant is obtained from polyisobutylene having a number average molecular weight of about 2000 to about 2400 and the second dispersant is obtained from polyisobutylene having a number average molecular weight of about 950.

35. The lubricating and cooling fluid of claim 21 wherein the base oil includes Group III base oil.

36. The lubricating and cooling fluid of claim 21 wherein the base oil includes gas-to-liquid (GTL) base oil.

37. The lubricating and cooling fluid of claim 21 wherein the base oil includes a polyalphaolefin (PAO) base oil.

38. The lubricating and cooling fluid of claim 21, wherein the lubricating fluid further comprises a sulfurized ester delivering about 180 to about 300 ppm sulfur to the lubricating fluid.

39. The lubricating and cooling fluid of claim 38, wherein the combination of the at least one thiadiazole or hydrocarbyl-substituted derivatives thereof and the sulfurized ester deliver about 1400 to about 1800 ppm sulfur to the lubricating fluid.

* * * * *